United States Patent [19]

Abe

[11] Patent Number: 4,982,685

[45] Date of Patent: Jan. 8, 1991

[54] CLIP-CARRYING BOOKMARKER

[76] Inventor: Mitsuhiko Abe, No. 278-1, Zennoji, Sakado, Saitama-ken, Japan

[21] Appl. No.: 468,671

[22] Filed: Jan. 23, 1990

[51] Int. Cl.[5] ..... B42D 9/00

[52] U.S. Cl. ..... 116/237; 116/239; 281/42; 40/514

[58] Field of Search ..... 116/237, 234, 238, 239, 116/235, 236; 281/42; 40/334, 335, 116, 514, 517

[56] References Cited

U.S. PATENT DOCUMENTS

| | | | |
|---|---|---|---|
| 991,608 | 5/1911 | Day | 40/514 |
| 2,111,362 | 3/1938 | Fisher | 40/335 |
| 2,490,621 | 12/1949 | Colomer | 40/514 |
| 2,911,940 | 11/1959 | Greider | 281/42 |
| 3,143,998 | 8/1964 | Madden | 116/238 |
| 3,308,784 | 3/1967 | Miller | 116/237 |
| 3,898,951 | 8/1975 | Clare | 116/239 |
| 4,041,892 | 8/1977 | Nichols | 116/239 |
| 4,505,219 | 3/1985 | Mangano | 116/234 |
| 4,869,196 | 9/1989 | Northcutt | 116/234 |

*Primary Examiner*—William A. Cuchlinski, Jr.
*Assistant Examiner*—C. W. Fulton
*Attorney, Agent, or Firm*—Armstrong, Nikaido, Marmelstein, Kubovcik and Murray

[57] ABSTRACT

A clip-carrying bookmarker the clip of which is adapted to be held on a cover of a book and extends downward from a strap storage box having a strap withdrawal port from which a strap provided in a wound state in the box and having a tag at the free end portion thereof can be drawn out to a desired length. After the strap has been drawn out to an arbitrary length, the tag is released from the fingers of a user, a pair of ratchets provided in the strap storage box are engaged to prevent a strap feed and take-up drum provided in the same box from being turned. Accordingly, the strap drawn out to a desired length is maintained as it is, the strap being then inserted between pages of an object book. When an operating shaft member projecting outward from a side wall of the strap storage box is pressed, the ratchets are disengaged from each other, so that the strap feed and take-up drum is rendered rotatable to enable the length of the strap drawn out to be reduced, and the strap to be rewound. Therefore, the length of the strap to be inserted between pages of a book can be set in accordance with the height of the book.

1 Claim, 3 Drawing Sheets

CLIP-CARRYING BOOKMARKER

BACKGROUND OF THE INVENTION

1. Field of the Invention

This invention relates to a clip-carrying bookmarker.

2. Description of the Prior Art

A conventional bookmarker consists generally of an elongated piece of paper A, and a string B fastened to the paper A, as shown in FIG. 8. This bookmarker is simply inserted between pages of a book. Therefore, while a user carries a book with such a bookmarker inserted between pages thereof, or the moment he opens such a book, the bookmarker slips off and is lost in many cases. In view of this inconvenience, a clip-carrying bookmarker shown in FIG. 9 was proposed. This clip-carrying bookmarker consists of a book cover-holding clip C formed by bending a resilient plate of a plastic in the shape of the letter "U", and a strap E which is to be inserted between pages of a book, and which is fastened to a bent base portion C' of the clip C via a ring D.

This clip-carrying bookmarker can remove the faults of the stringed bookmarker mentioned above, in such respects that, when a user carries a book with the clip-carrying bookmarker inserted therein or opens such a book, the bookmarker does not slip off. However, since the length of the strap E is invariable, the kinds of books to which this bookmarker can be applied are necessarily limited. There are books of various sizes, for example, books of a large height and books of a small height. The strap of a conventional clip-carrying bookmarker is set to be rather long so that the bookmarker can be applied to the largest possible number of kinds of books. Therefore, when this clip-carrying bookmarker is applied to a book of a small height, the lower end portion of the strap projects largely from the lower end of the book to present an unshapely appearance. Conversely, when the clip-carrying bookmarker is applied to a book of a large height, it cannot be used conveniently due to the unsatisfactorily small length of the strap thereof.

SUMMARY OF THE INVENTION

An object of the present invention, which has been achieved in view of these points, is to provide a clip-carrying bookmark capable of regulating the length of a strap, which is fastened to a clip thereof, in accordance with the height of an object book to enable the above-mentioned problems to be solved, and of retracting the strap in a wound state into a strap storage box when the bookmarker is not used.

The above and other objects as well as advantageous features of the invention will become apparent from the following description of the preferred embodiment taken in conjunction with the accompanying drawings.

DESCRIPTION OF THE PREFERRED EMBODIMENT

Figure 1:
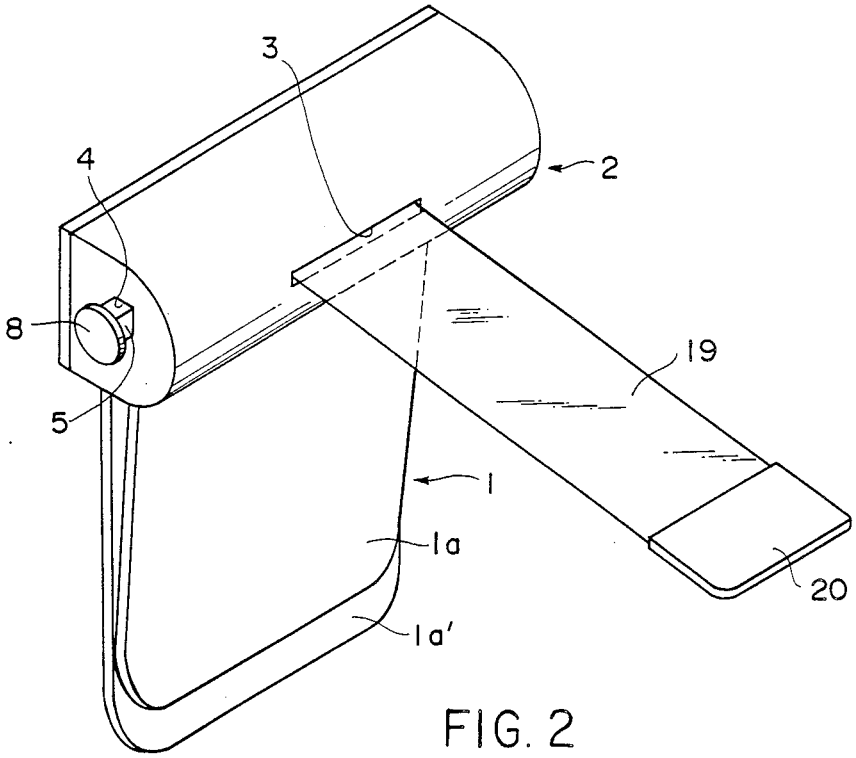
FIG. 1 is a perspective view of an embodiment of the present invention with a strap payed out to a certain extent.

The present invention will now be described on the basis of an embodiment thereof shown in the drawings.

Figure 2:
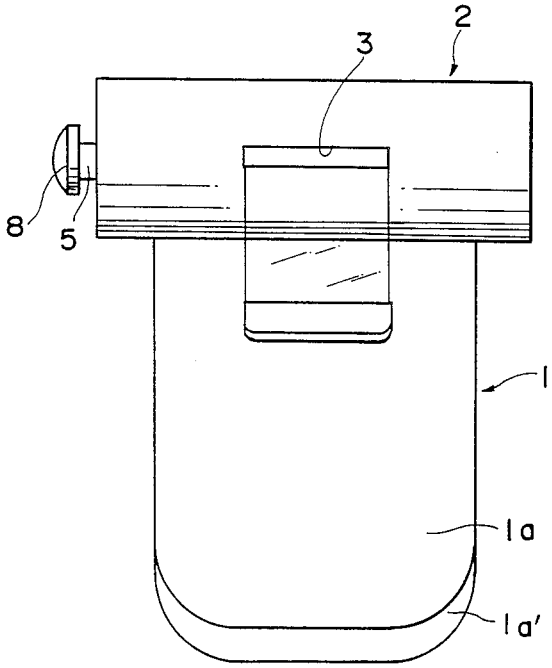
FIG. 2 is a front elevation of the embodiment.
Figure 3:
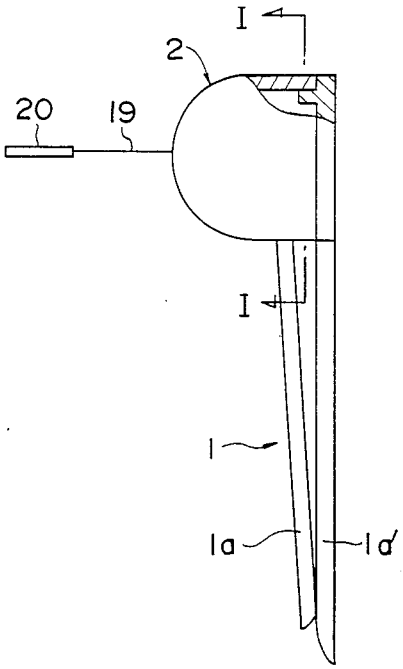
FIG. 3 is a side elevation of the embodiment.
Figure 5:
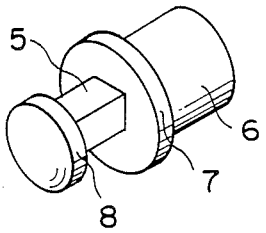
FIG. 5 is a perspective view of a drum-carrying operating shaft member.
Figure 6:
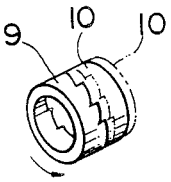
FIG. 6 is a perspective view of a pair of ratchets.
Figure 4:
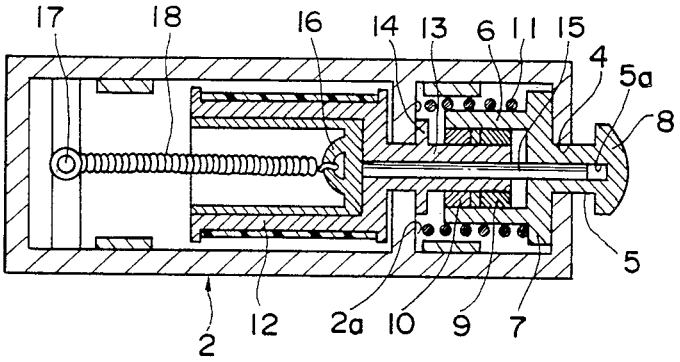
FIG. 4 is a sectional view taken along the line I—I in FIG. 3.
Figure 7:
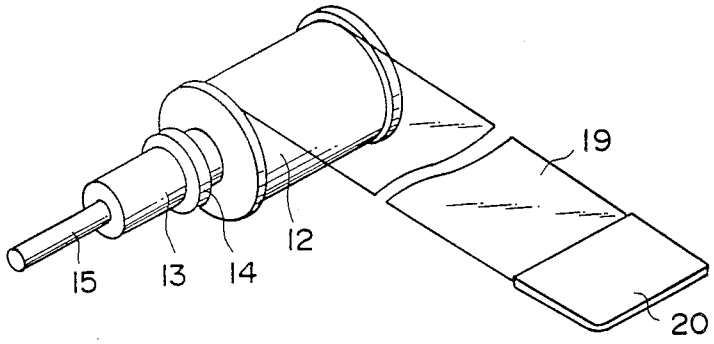
FIG. 7 is a perspective view of a strap feed and take-up drum provided with a support shaft.
Figure 9:
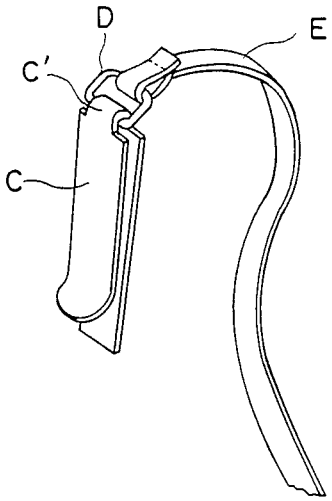
FIG. 9 PRIOR ART
FIG. 9 is a perspective view of a conventional example provided with a clip.
Figure 8:
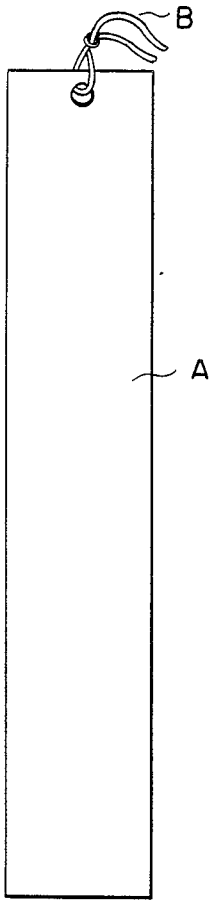
FIG. 8 PRIOR ART
FIG. 8 is a front elevation of a conventional example consisting of an elongated piece of paper, and a string fastened to the paper.

FIG. 1 is a perspective view of an embodiment of the present invention with a strap payed out to a certain extent, FIG. 2 a front elevation of the embodiment, FIG. 3 a side elevation of the embodiment, FIG. 4 a sectional view taken along the line I—I in FIG. 3, FIG. 5 a perspective view of a drum-carrying operating member, FIG. 6 a perspective view of a pair of ratchets and FIG. 7 a perspective view of a strap feed and take-up drum provided with a support shaft.

Referring to the drawings, a reference numeral 1 denotes a clip formed out of a resilient material, such as plastics and consisting of a pair of opposed clamp members 1*a*, 1*a*'. These two clamp members 1*a*, 1*a*' are adapted to hold a cover of a book therebetween. The clamp members 1*a*, 1*a*' are provided at the lower side of a strap storage box which will be described later.

A reference numeral 2 denotes a strap storage box formed out of the same material as the clip 1. The strap storage box 2 is provided with a strap withdrawal port 3 at the central portion of the front surface thereof, and a square hole 4, through which an operating shaft member 5 which will be described later is fitted slidable, in a side wall thereof.

A reference numeral 5 denotes an operating shaft member having a square cross section and fitted slidably in the square hole 4 in the strap storage box 2. A drum 6 having a flange 7 is provided on the end portion of the operating shaft member 5 which is on the inner side of the strap storage box 2, and a knob 8 on the end portion of the operating shaft member 5 which is on the outer side of the strap storage box 2. The operating shaft member 5 is further provided in its core portion with a small-diameter bore 5*a* in which a guide rod which will be described later is slidably fitted. This bore 5*a* is made so deep that the bore 5*a* has an empty portion of a small depth owing to which the outer end of the guide rod does not impinge upon the opposed end surface of the bore 5*a*. Reference numerals 9 and 10 denote a pair of ratchets. The ratchets 9, 10 are formed annularly, and have teeth, which are meshed with each other, on the opposed surfaces thereof. One ratchet 9 out of these ratchets 9, 10 is mounted immovably on the free end portion of a support shaft of a strap feed and take-up drum which will be described later, and the other ratchet 10 is also mounted on the same shaft and fitted firmly into the drum 6 provided on the operating shaft member 5, in such a manner that the ratchet 10 is moved with the drum 6.

A reference numeral 11 denotes a coiled spring. This spring 11 is provided between the flange 7 of the drum 6 and a support wall 2*a* in the strap storage box 2 so that the spring 11 constantly urges the drum 6 toward the outside of the strap storage box 2.

A reference numeral 12 denotes a strap feed and take-up drum. This drum 12 is opened at one end thereof, and closed at the other end thereof. It is provided with a support shaft 13 projecting outward from the closed end thereof, and inserted through a bore 2a' in the support wall 2a of the strap storage box 2 so that the support shaft 13 can be turned. The support shaft 13 is provided with a flange 14 so that the shaft 13 is not displaced unnecessarily in the axial direction thereof.

A reference numeral 15 denotes a guide rod fitted firmly in the core portion of the support shaft 13, and the free end portion, which projects from the support shaft 13, of this guide rod 15 is fitted slidably in the bore 5a in the operating shaft member 5.

A reference numeral 16 denotes a ring-shaped catch for a rubber string, the catch 16 being provided in the strap feed and take-up drum 12.

A reference numeral 17 denotes a rubber string fastening projection provided in the strap storage box 2.

A reference numeral 18 denotes a rubber string. This rubber string 18 is provided so as to extend in a twisted state between the ring-shaped catch 16 and rubber string fastening projection 17. The rubber string 18 is provided for the purpose of urging the strap feed and take-up drum 12 constantly in the direction in which the strap is taken up.

A reference numeral 19 denotes a strap made by cutting a transparent plastic film to the shape of a belt. The strap 19 is fastened at its one end portion to the strap feed and take-up drum 12, and wound in its entirety around the same drum 12. The other end portion of the strap 19 projects outward through the strap withdrawal port 3, and provided with a tag 20 at its free and portion.

The operation of this embodiment will now be described.

First, the clip 1 is held on a cover of a book (not shown). The tag 20 is then held between the user's fingers, and the strap 19 is drawn out to a required length in accordance with the height of the book. While the strap is being drawn out, the teeth of one ratchet 9 out of the two ratchets 9, 10 mounted fixedly on the support shaft 13 slip on those of the other 10, so that the strap 19 can be freely drawn out. When the fingers are released from the tag 20 after the strap 19 has been drawn out to an arbitrarily predetermined length, a force by which the strap feed and take-up drum 12 rewinds the strap 19 occurs due to the operation of the rubber string 18. However, at this time, the teeth of the ratchet 9 are meshed with those of the other 10 to prevent the strap feed and take-up drum 12 from being further turned. Consequently, the rewinding movement of the strap feed and take-up drum 12 is prevented, and the strap thus drawn out is maintained as it is at the mentioned length.

In order to reduce the length of the strap 19 which has already been drawn out or in order to retract such a strap into the strap storage box 2, the operating shaft member 5 may be pressed against the resilient force of the coiled spring 11. When the operating shaft member 5 is pressed, the ratchet 10 fitted in the drum 6 disengages from the ratchet 9 on the support shaft 13, and the strap feed and take-up drum 12 becomes rotatable. The strap 19 drawn out is then taken up around this drum 12.

The present invention having the above-described construction and operation enables the length of the strap attached to the clip to be regulated suitably in accordance with the height of an object book. Therefore, unlike a conventional clip-carrying bookmark, which projects largely from a book, or which is too short to be used conveniently, the clip-carrying bookmark according to the present invention can perfectly solve these problems. Moreover, while the bookmarker according to the present invention is not in use, the strap can be held in a rewound state in the strap storage box.

The present invention is not, of course, limited to the above embodiment; it may be modified in various ways within the scope of the appended claim.

What is claimed is:

1. A clip-carrying bookmarker comprising a clip formed out of a resilient material and consisting of a pair of clamp members provided on a lower side of a strap storage box; said strap storage box being provided with a strap withdrawal port at a central portion of a front side thereof and a square hole in a side wall thereof; a cross-sectionally square operating shaft member fitted slidably through said square hole in said strap storage box, and having a flange-carrying drum at an end portion of said operating shaft member which is located inside of said strap storage box, and a small diameter bore of a predetermined depth in a core portion of said operating shaft member; a coiled spring provided between the flange of said flange carrying drum of said operating shaft member and a support wall in said strap storage box and urging said flange carrying drum constantly toward the outside of said strap storage box; a strap feed and take-up drum opened at one end thereof and closed at the other, and provided with a support shaft projecting outward from said closed end thereof and fitted rotatably through a bore made in said support wall in said strap storage box; a guide rod fitted fixedly in a core portion of said support wall and fitted slidably at its free end portion in said bore in said operating shaft member; a pair of annular ratchets having teeth, which can be meshed with each other, on the opposed surfaces of said annular ratchets, one ratchet being mounted immovably on the free end portion of said support shaft of said strap feed and take-up drum, the other ratchet being fitted firmly into said flange carrying drum of said operating shaft member and movable with said flange carrying drum; a rubber string provided in a twisted state and set at one end on a rubber string fastening catch formed at a central portion of the inner surface of said strap feed and take-up drum and at the other end on a rubber string fastening projection formed in the interior of said strap storage box; and a strap fastened at its one end portion to said strap feed and take-up drum and wound in its entirety around said strap feed and take-up drum, and paid out at the other end portion thereof through said strap withdrawal port with a tag provided on a second end portion of said strap.

* * * * *